US006387533B1

(12) United States Patent
Ast et al.

(10) Patent No.: US 6,387,533 B1
(45) Date of Patent: May 14, 2002

(54) HOLLOW PROFILE HAVING AT LEAST ONE LATERALLY PROTRUDING FLANGE AND A METHOD FOR THE PRODUCTION THEREOF

(75) Inventors: Günther Ast, Starzach; Konrad Eipper, Rottenburg, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/448,863

(22) Filed: Nov. 23, 1999

(30) Foreign Application Priority Data

Nov. 24, 1998 (DE) ..... 198 54 076

(51) Int. Cl.[7] ..... B32B 1/08; B21D 22/00; E04C 3/04; F16B 11/00

(52) U.S. Cl. ..... 428/582; 428/586; 428/598; 52/589.1; 52/763

(58) Field of Search ..... 428/582, 598, 428/586; 29/521; 52/470, 471, 472, 732.2, 763, 589.1, 717.06

(56) References Cited

U.S. PATENT DOCUMENTS 3,858,647 A * 1/1975 Hickman ..... 165/171
4,327,514 A * 5/1982 Borque ..... 40/607
4,409,769 A * 10/1983 Redman ..... 52/475
4,805,783 A * 2/1989 Mayer ..... 211/94
5,150,501 A * 9/1992 Pasternak ..... 16/272
5,706,620 A * 1/1998 De Zen ..... 52/220.2
5,839,777 A * 11/1998 Viahovic ..... 296/205
5,979,119 A * 11/1999 Trafton ..... 52/40
6,253,525 B1 * 7/2001 Weber ..... 52/735.1

FOREIGN PATENT DOCUMENTS

| | | | |
|---|---|---|---|
| DE | 41 29 329 A 1 | | 11/1993 |
| EP | 0749892 A1 | | 12/1996 |
| GB | 2328393 A | | 2/1999 |
| WO | WO 99/03717 | * | 1/1999 |

* cited by examiner

*Primary Examiner*—John J. Zimmerman
(74) *Attorney, Agent, or Firm*—Crowell & Moring LLP

(57) ABSTRACT

A hollow profile having at least one laterally protruding flange and a method for the production thereof. The hollow profile having a hollow profile blank and a sheet metal strip. The hollow profile blank and the sheet metal strip each having a joining element and being adapted to be joined in a locking relationship. Wherein a hydraulic internal high pressure is generated within the hollow-profile blank and the joining element of the hollow-profile blank is shaped, whereby a non-releasable clamping action is formed between the joining elements of the hollow profile blank and the sheet metal strip.

6 Claims, 1 Drawing Sheet

HOLLOW PROFILE HAVING AT LEAST ONE LATERALLY PROTRUDING FLANGE AND A METHOD FOR THE PRODUCTION THEREOF

FIELD OF THE INVENTION

The invention relates to a hollow profile, in particular an extruded profile, having at least one laterally protruding flange, in vehicle or aircraft construction, and to a method for the production thereof.

BACKGROUND OF THE INVENTION

At present, hollow profiles having a flange can only be bent with great difficulty, since the stresses in the flange very rapidly reach their limit and then the hollow profile tears at this point. Hollow profiles of this type also cause difficulties in other types of deformation techniques, for example the internal high-pressure deformation technique. If, in this case, the flange is clamped in the manner of deep-drawing between the deforming-appliance parts, during the expansion by means of internal high pressure hollow-profile material flows away from the flange region into the regions to be expanded, as a result of which tears can easily be produced during the deformation procedure on account of the thinning of the material. This does not in any way produce deformation which is reliable during the process.

A hollow profile of the generic type is disclosed in DE 41 29 329 A1. In this case, a hollow profile is connected to a sheet-metal section by means of a connecting element formed as an expanding-profile body in such a manner that the joint produced as a result can be subjected to a high mechanical load. This connection is relatively complex on account of the use of the additional connecting element because of its production and installation. If, in order to simplify the connection, the expanding-profile body is dispensed with, during deformation of the hollow profile the sheet-metal section is at least displaced in the circumferential direction of the bent sheet-metal end, or the sheet-metal section can even become detached from the hollow profile. As a result, the reliability during the process when the hollow profile is deformed is not ensured.

The present invention is aimed at overcoming one or more of the problems as set forth above.

SUMMARY OF THE INVENTION

The invention is based on the object of developing a hollow profile of the generic type to the effect that said hollow profile can be deformed in a simple manner and ensuring the reliability during the process. Furthermore, the intention is to indicate a method for its production.

The invention enables the hollow profile to be manufactured with a flange by a modular design consisting of a flangeless hollow-profile blank and sheet-metal strip, as a result of which the hollow profile can be deformed freely within wide limits. In particular, it is now possible for the deformation which is required for a desired divergence of the hollow profile from a rectilinear extent, for example deformation under bending conditions, to be carried out, in a simple manner, with less outlay on constructional tools and in a reliable manner during the process, solely on the rectilinear, flangeless hollow-profile blank, after which the flange, which is formed by the sheet-metal strip, is only mounted on the hollow-profile blank, in order to form the hollow-profile end form, once the said deformation of the hollow-profile blank has taken place. In order to connect the said flange to the hollow profile likewise in a simple and non-releasable manner and thereby to achieve the required flexural strength of the hollow profile, and also to secure the mounting flange rigidly to the hollow profile in order to effectively install the hollow profile, intimate interlocking between the two joining partners—the sheet-metal strip and the hollow-profile blank, is necessary. For this purpose, the joining partners are a priori designed with joining elements which can be intermeshed, the final interlocking between the joining elements being achieved by internal high-pressure deformation of the hollow-profile blank. In this process, the material of the blank flows to the contour of the joining element of the sheet-metal strip and positions itself there in an identical form, after which work-hardening under cold conditions takes place. The expansion of the blank caused by internal high pressure is not affected by the flange, since the said flange as a separate component is connected to the blank by another material and not integrally. Therefore, even when the flange is mounted, the reliability during the process is ensured. Also, a certain cross-sectional shaping of the hollow profile can readily take place with reliability during the process by means of internal high-pressure deformation prior to or at the same time as the mounting of the flange, the flange in no way adversely affecting the deformation for the same reasons. Furthermore, the invention makes it possible to provide the flange on the hollow profile in a specific manner, to be precise only in the regions in which it is required for the mounting. Until now, in the case of the known hollow profiles having a flange the flanges had to be partially cut to length and/or milled off, which, because of the additional processing step, is complicated and expensive, and overall requires an unnecessarily large amount of material. In contrast, in addition to a reduced consumption of material and improved protection of resources—a not insignificant aspect for the lightweight construction, the hollow profile according to the invention, because of the saving on material, produces a saving on weight and also, at the flangeless locations, additional constructional space which can be used, for example, for an increased cross-sectional enlargement of the hollow profile by means of internal high pressure or for freer designing of those components of the vehicle which are adjacent to the hollow profile.

BRIEF DESCRIPTION OF THE DRAWINGS

Expedient refinements of the invention can be gathered from the subclaims; moreover, the invention is explained in more detail below with reference to a plurality of exemplary embodiments illustrated in the drawings; in the drawings:

DETAILED DESCRIPTION OF THE PREFERRED EMBODIMENT

Figure 1:
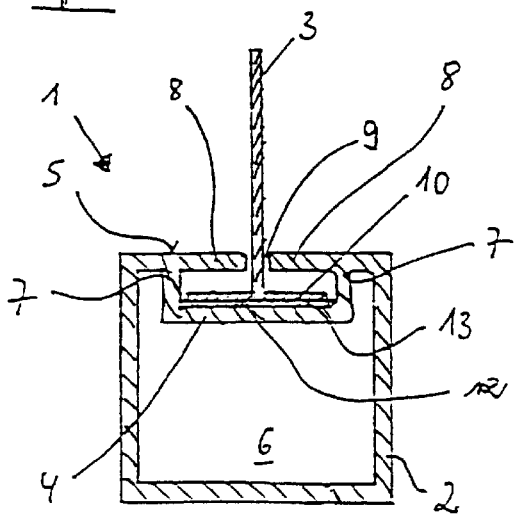
FIG. 1 shows, in a cross section, a hollow profile according to the invention having a flange with a groove formed in the hollow profile, prior to the internal high-pressure deforming procedure.

FIG. 1 shows a hollow profile 1 having a rectangular cross section, which profile is manufactured as an extruded profile. The hollow profile 1, which consists of a flangeless hollow-profile blank 2 and a separate sheet-metal strip 3 which forms the flange, has, as a joining element for joining the sheet-metal strip 3 to the hollow-profile blank 2, a groove 4 which originates from the extrusion process, runs along the hollow-profile blank 2 and is formed in the hollow-profile blank wall 5 in a manner such that it is arranged offset with respect to the interior 6 of the hollow-profile blank 2. The groove 4 is covered from the groove edge 7 by protruding wall sections 8 of the hollow-profile blank 2 except for an approximately centrally situated slot 9 which is of a larger size than the wall thickness of the sheet-metal strip 3. In other designs, the slot 9 may also be situated eccentrically.

The sheet-metal strip 3 is designed in the form of a T-profile, the joining element of the sheet-metal strip 3, which joining element corresponds to the joining element of the hollow-profile blank 2, being formed by the transverse web 10 of the T-profile. The width of the sheet-metal strip 3 differs in size depending on the intended use. The depth of the groove is of such a size that the sheet-metal strip 3 can be inserted with its transverse web 10 with a clearance, after which the sheet-metal strip 3 protrudes with its remaining section through the slot 9. After the transverse web 10 is axially inserted into the groove 4, which forms a holder, the two joining partners—the sheet-metal strip 3 and hollow-profile blank 2, are loosely joined together.

After the subsequent positioning of the sheet-metal strip 3 or its transverse web 10 in the groove 4, the loose composite consisting of the sheet-metal strip 3 and hollow-profile blank 2, is inserted into an internal high-pressure deforming appliance. In the closed state of the appliance, the hollow-profile blank 2 is then filled with a pressure fluid and via the pressure fluid is exposed to an internal high pressure of at least several hundred or even up to 3000 bar.

Figure 2:
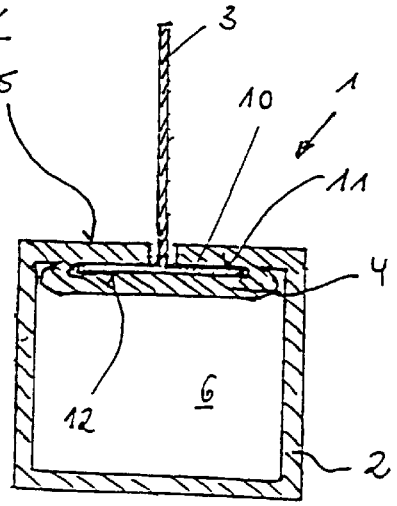
FIG. 2 shows the hollow profile from FIG. 1 in a cross section after the internal high-pressure deformation.

The material of the hollow-profile blank begins to flow under this pressure, in which case, according to FIG. 2, the groove 4 and the wall sections 8 of the hollow-profile blank 2 as it were nestle against the transverse web 10 in an interlocking manner and the said web is therefore held in a press fit. In the process, the transverse web 10 is compressed with the wall sections 8 and the groove 4 in such a manner that a non-releasable bond is produced between the sheet-metal strip 3 and hollow-profile blank 2, the sheet-metal strip 3 protruding rigidly laterally outwards from the bond. In this case, the rear side 11 of the transverse web 10 forms the undercut surfaces of the joining element of the sheet-metal strip 3 against which those wall sections 8 which cover the groove 4 bear in a manner such that they grip from behind, as a result of which the sheet-metal strip 3 is retained captively in the groove 4.

For better fixing in the joining position prior to the internal high-pressure deformation, the groove 4 and/or the lower side 12 of the transverse web 10 is/are coated with an adhesive 13. After the transverse web 10 of the sheet-metal strip 3 is positioned in the groove 4, the sheet-metal strip 3 is bonded to the hollow-profile blank 2 by pressing against the transverse web 10 which is coated with the adhesive 13. The bonding may also take place during the compression of the transverse web 10 which is caused by the internal high pressure. The fixing may otherwise also be achieved by slight mechanical deformation of the extruded-profile blank 2 in the region of the groove 4.

Moreover, prior to the joining the hollow-profile blank 2 has already undergone deformation in terms of deformation under bending conditions or a first profiling internal high-pressure deforming process. The use of the hollow profile 1, which is completed after the joining and the following internal high-pressure deforming process to give the non-releasable clamping action between the two intermeshing joining partners—the sheet-metal strip 3 as the flange and the hollow-profile blank 2, resides in body building in the case of motor vehicles, in particular passenger cars, or in aircraft construction.

Figure 3:
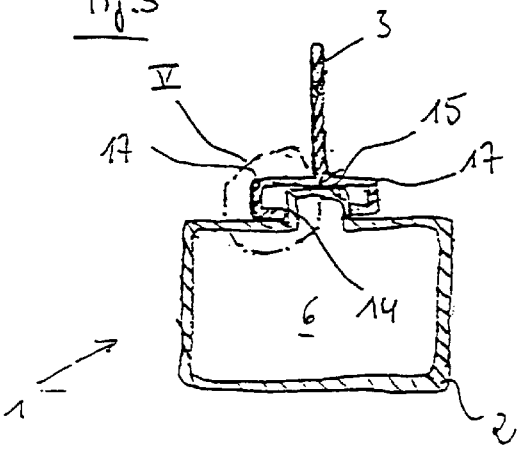
FIG. 3 shows, in a cross section, a hollow profile according to the invention having a flange with a bent-out portion of the hollow profile, prior to the internal high-pressure deforming procedure.
Figure 4:
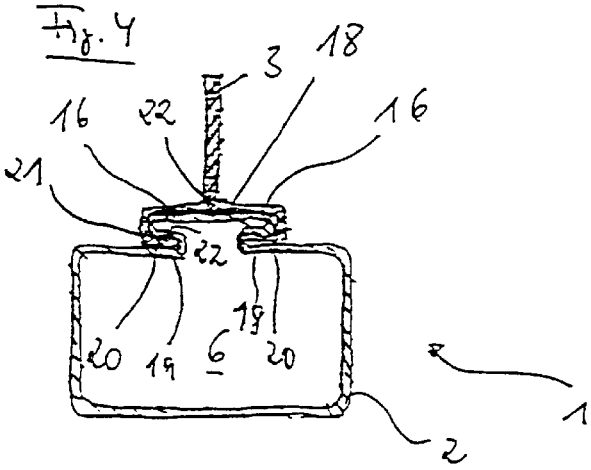
FIG. 4 shows the hollow profile from FIG. 3 in a cross section after the internal high-pressure deformation.
Figure 5:
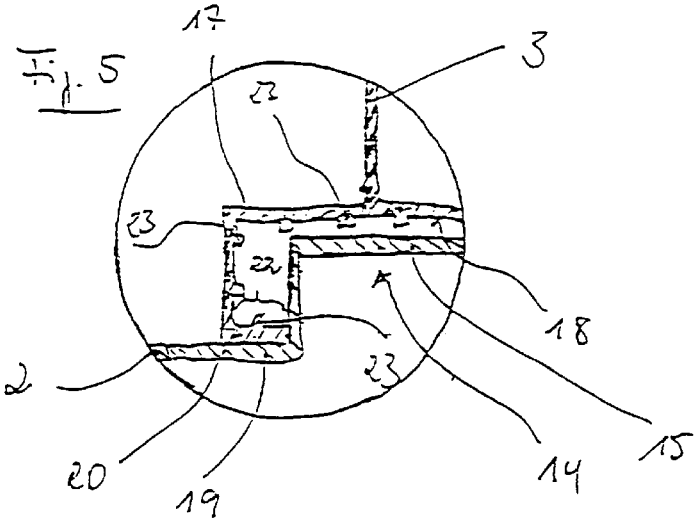
FIG. 5 shows, in an enlarged detail, a modification of the hollow profile from FIG. 3 with ribs formed on the inside of the claw of the sheet-metal strip.

FIGS. 3-5 show an alternative to the preceding exemplary embodiment. As a departure from this, the joining element of the hollow-profile blank 2 is formed by a bent-out portion 14 of the blank wall 5, which bent-out portion 14 extends in a rail-like manner over the length of the blank 2. The bent-out portion 14 has in the covering region 15 a radially extending projecting length 16 on both sides (FIG. 4). The joining element of the sheet-metal strip 3 forms a claw 17 which is formed on the end side of said sheet-metal strip 3 and grips behind the projecting length 16 on the lower side 21 thereof, the bent-out portion 14, which is formed with a rectangular cross section, bears such that it is pressed in an interlocking manner against the inside 18 of the claw 17. The section 22 of the inside 18 of that part 20 of the claw 17 which grips the projecting length 16 from behind forms the undercut surfaces of the joining element of the sheet-metal strip 3 for the joining element of the hollow-profile blank 2. The wall section 19, which is directly adjacent to the bent-out portion 14, of the hollow-profile blank 2 which is deformed by internal high pressure is pressed against that part 20 of the claw 17 which grips from behind.

According to FIG. 3 the joining partners are connected loosely to one another by their bent-out portion 14 and the claw 17 being fitted together. In this joining state the bent-out portion 14 does not yet have a projecting length 16. After the loose joining composite has been fitted together and introduced into a cavity, appropriately suitable for its outer contours, in an internal high-pressure deforming appliance, the bent-out portion 14 of the blank wall 5, by an internal high pressure being generated within the hollow-profile blank 2, is shaped, expanding it, into an end form, the projecting length 16, which bears in an interlocking manner against the entire inside 18 of the claw 17 of the sheet-metal strip 3 and is of a reverse form with respect to the contour of this inside 18, such that in this manner by the compressed gripping of the projecting length 16 from behind by the claw 17, the joining composite, which for the time being is loose, is clamped non-releasably.

In order to strengthen the clamping action and therefore to increase the strength of the joining connection, the claw 17, as is shown in FIG. 5, can have ribs 23 which are distributed over its inside 18 and protrude radially inwards. After the interlocking positioning of the material of the hollow-profile blank against the inside 18 of the claw 17 by internal high pressure, the ribs 23 form barbs for the bent-out portion 14, so that the sheet-metal strip 3 can be connected to the hollow-profile blank 2 only by destroying at least one of the joining partners.

The foregoing disclosure of embodiments of the present invention has been presented for purposes of illustration and description. It is not intended to be exhaustive or to limit the invention to the precise forms disclosed. Many variation and modifications of the embodiments described herein will be obvious to one of ordinary skill in the art in light of the above disclosure. The scope of the invention is to be defined only by the claims appended hereto, and by their equivalents.

What is claimed is:

1. A hollow extruded profile with at least one laterally protruding flange, the hollow profile comprising a flangeless hollow-profile blank and a separate sheet-metal strip which subsequently forms the flange, joining elements which intermesh in a joining position being formed on the hollow-profile blank and on the sheet-metal strip, the joining element of the sheet-metal strip having undercut surfaces which are gripped from behind in an interlocking manner by the joining element of the hollow-profile blank in a non-releasable clamping action, wherein the sheet-metal strip is designed as a T-profile, and the joining element of the sheet-metal strip is formed by a transverse web, and wherein the joining element of the hollow-profile blank is designed as a groove which is formed in a hollow-profile blank wall and is covered by wall sections of the hollow-profile blank except for an approximately centrally situated slot which is at least the size of the wall thickness of the sheet-metal strip, in said groove the transverse web being mounted in a press fit, a rear side of the transverse web forming the undercut surfaces of the joining element of the sheet-metal strip, the wall sections which cover the groove bearing against said surfaces upon the groove being deformed by internal pressure.

2. A hollow profile according to claim 1, wherein the groove or the lower side of the transverse web is coated with an adhesive.

3. A hollow extruded profile with at least one laterally protruding flange, the hollow profile comprising a flangeless hollow-profile blank and a separate sheet-metal strip which subsequently forms the flange, joining elements which intermesh in a joining position being formed on the hollow-profile blank and on the sheet-metal strip, the joining element of the sheet-metal strip having undercut surfaces which are gripped from behind in an interlocking manner by the joining element of the hollow-profile blank in a non-releasable clamping action, wherein the joining element of the hollow-profile blank is formed by a rail bent-out portion of the blank wall, said bent-out portion in a covering region having a radially extended projecting length on both sides, and wherein the joining element of the sheet-metal strip has a claw which is formed on an end side, grips the projecting length from behind and against an inside of the claw the bent-out portion bears in an interlocking manner, with a section of the wall, which is directly adjacent to the bent-out portion, of the hollow-profile blank which is deformed by internal high pressure being pressed against a part of the claw which grips from behind.

4. A hollow profile according to claim 3, wherein the claw has ribs which are distributed over the inside and protrude radially inwards.

5. An apparatus, comprising:

a flangeless hollow-profile blank having a groove, the groove being formed by a hollow-profile blank wall and wall sections of the hollow-profile blank, the groove having a slot approximately centrally situated in the hollow-profile blank, and a separate sheet metal strip having a flange and a transverse web, the flange and the transverse web having a generally T-shaped profile, the transverse web having a rear side with undercut surfaces, wherein the transverse web is mounted in a press fit in the groove with the wall sections bearing on the undercut surfaces thereby gripping the flange in a non-releasable clamping action upon the groove being deformed by internal pressure.

6. An apparatus, comprising:

a flangeless hollow-profile blank having a rail bent-out portion, the rail bent-out portion being formed by a hollow-profile blank wall, and a sheet metal strip having a flange and forming a claw which grips the rail bent-out portion, wherein the rail bent-out portion bears against inside surfaces of the claw in an interlocking manner upon the bent-out portion being deformed laterally into the claw by internal pressure.

* * * * *